US008376167B2

(12) United States Patent
Lovelace et al.

(10) Patent No.: US 8,376,167 B2
(45) Date of Patent: Feb. 19, 2013

(54) PORTABLE RESERVOIR FRAME

(75) Inventors: Sean Michael Lovelace, Casper, WY (US); Christopher Jason Songe, Casper, WY (US)

(73) Assignee: Energy Innovations, LLC, Casper, WY (US)

( * ) Notice: Subject to any disclaimer, the term of this patent is extended or adjusted under 35 U.S.C. 154(b) by 0 days.

(21) Appl. No.: 13/469,883

(22) Filed: May 11, 2012

(65) Prior Publication Data

US 2012/0223073 A1 Sep. 6, 2012

Related U.S. Application Data

(63) Continuation of application No. 13/245,492, filed on Oct. 21, 2011.

(51) Int. Cl.
*B65D 6/00* (2006.01)

(52) U.S. Cl. ..... 220/4.17; 220/4.16; 220/693; 220/567; 220/4.12

(58) Field of Classification Search ..... 220/1.6, 220/4.12, 4.16, 4.17, 9.4, 23.9, 495.06, 495.08, 220/567, 681, 693
See application file for complete search history.

(56) References Cited

U.S. PATENT DOCUMENTS

| | | | | |
|---|---|---|---|---|
| 1,875,666 | A * | 9/1932 | Schwemlein | 220/693 |
| 3,233,251 | A * | 2/1966 | Barrera | 52/245 |
| 3,648,303 | A * | 3/1972 | Stewart et al. | 52/5 |
| 4,124,907 | A * | 11/1978 | Laven | 52/169.7 |

FOREIGN PATENT DOCUMENTS

| | | |
|---|---|---|
| CA | 2692016 | 7/2010 |

* cited by examiner

*Primary Examiner* — Anthony Stashick
*Assistant Examiner* — Christopher McKinley
(74) *Attorney, Agent, or Firm* — Gordon Silver, Ltd.; Ronald C. Gorsché

(57) ABSTRACT

A portable reservoir frame composed of interlocking panels secured by a series of flanges having holes and pegs. An inner liner to hold liquid inside the reservoir frame is presented.

16 Claims, 11 Drawing Sheets

PORTABLE RESERVOIR FRAME

FIELD OF THE INVENTION

This invention relates generally to a reservoir frame capable of being transported to various geographical areas, placed on or in the ground and able to provide containment for various liquids.

BACKGROUND OF THE INVENTION

Often in various industries is necessary to hold and contain various industrial liquids from process activity. In the oil and gas industry, for example, it is often necessary to contain fracturing fluid, which is a byproduct of drilling activity. Currently, trailers are used to hold and contain this liquid.

To accommodate oil and gas production in the field, a trailer is transported to the site where the liquid is produced. The trailers often have a 500 barrel capacity, so multiple trailers are needed in situations where much liquid is stored.

The cost of trucking trailers to various oil and gas drilling locations is significant. Additionally, transporting said liquid from the production site adds to the already high cost of oil and gas drilling operations. Furthermore, environmental concerns associated with numerous containment trailers for the liquid has generated governmental regulations, including rules regarding environmental quality, transportation, safety and health, etc.

SUMMARY OF THE INVENTION

Accordingly, it is an object of embodiments of the present invention to provide a portable reservoir frame to aid in the storage of liquid materials.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the invention comprises a portable reservoir frame comprising two or more interlocking panels for deployment on a ground surface, each of said panels having the following: a plate having an outer surface, an inner surface, a top edge, a bottom edge for resting on the ground surface, a first edge and an opposing second edge, said first and said second edges being disposed between said top edge and said bottom edge; a first flange having an inner face, an outer face, and at least one hole having a chosen diameter and perforating said first flange, said first flange attached to said plate and extending beyond the first edge; a second flange having an inner face and an outer face, said second flange attached to said plate and extending beyond the opposing second edge; and at least one peg attached to said second flange and extending in a direction perpendicular to the outer face thereof, each of said at least one peg adapted for insertion into one of said at least one hole.

Benefits and advantages of the present invention include, but are not limited to, providing a reservoir frame, which is portable and can function in a variety of terrains, and accommodate a wide variety of ground surfaces.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
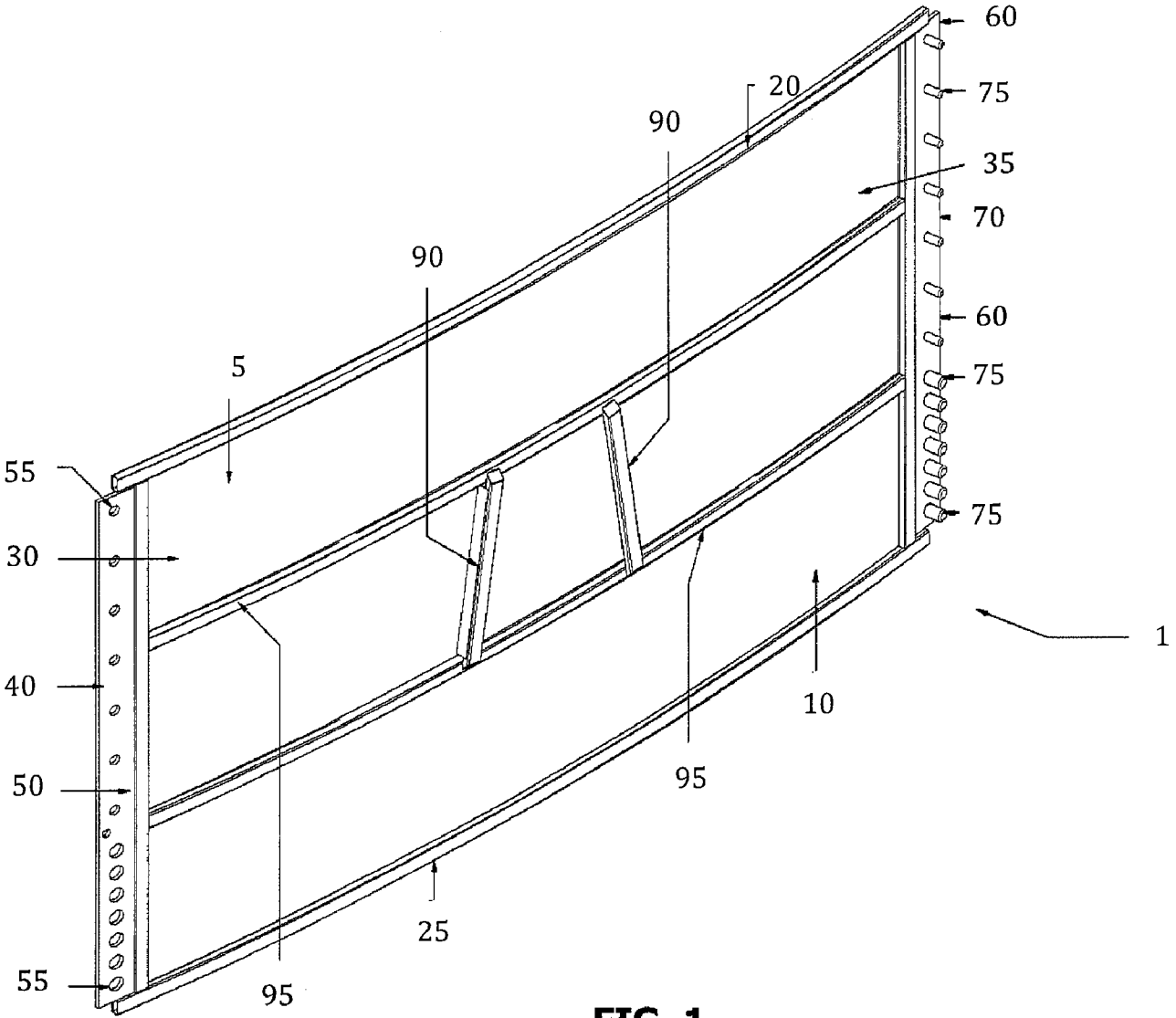
FIG. 1 illustrates a perspective view of one embodiment of the present invention showing a panel having an outer surface, first and second flanges and top edge.

Reference will now be made in detail to embodiments of the invention, examples of which are illustrated in the accompanying drawings. Throughout the following detailed description, the same reference characters refer to the same or similar elements in all FIG.s.

FIG. 1 illustrates a perspective view of one embodiment of the present invention showing a panel 1 having plate 5. As depicted in FIG. 1, the plate 5 of the panel 1 has an outer surface 10, a top edge 20, and a bottom edge 25. The bottom edge 25 is adapted to be disposed upon a ground surface. The plate 5 is attached to a first flange 40 at the first edge 30 of the plate 5. The plate 5 is attached to the second flange 60 at the opposing second edge 35 of the plate 5. FIG. 1 depicts the outer face 50 of the first flange 40 and the outer face 70 of the second flange 60.

FIG. 1 illustrates the first flange 40 having holes 55. In one embodiment of the present invention, the holes 55 are unevenly spaced, having a higher density of holes 55 toward the bottom of the first flange 40. The second flange 60 has pegs 75. In one embodiment, the pegs 75 extend in direction normal to the outer face 70 of the second flange 60 and are adapted for penetration of the holes 55. Similar to the holes 55 and in one embodiment of the present invention, the pegs 75 are unevenly spaced with a higher density of pegs disposed at the bottom of the second flange 60. The higher density of holes 55 and corresponding pegs 75 disposed toward the bottom of the first and second flanges provides for and accommodates more water to be placed in the reservoir. The additional water places more pressure toward the bottom of the flanges and a higher density of holes and pegs stabilize the bottom portion of the structure and further secures the connection between interconnected panels. In many embodiments of the present invention, the pegs 75 are integrally formed with the second flange 60.

FIG. 1 illustrates crossbars 90 that are used to attach temporarily a panel connector piece of a front end loader or tele-handler for transportation. Thus, a front end loader or tele-handler can easily manipulate and transport a panel during reservoir frame construction. In one embodiment, the crossbars 90 may be attached to the outer surface 10 of the panel 1. Additionally, FIG. 1 depicts horizontal support beams 95 to further secure and strengthen the panel 1 and plate 5. The horizontal support beams 95 are generally parallel to the top edge 20 and the bottom edge 25, and the horizontal support beams are disposed between the first edge 30 and opposing second edge 35. In another embodiment the crossbars 90 may be attached to the horizontal support beams 95.

In one embodiment of the present invention the panels have a curvature such that when numerous panels are interconnected via the pegs 75 and holes 55, a generally circular reservoir frame system is constructed. The curvature is generally convex relative to the outer surface and concave relative to the inner surface.

In various embodiments of the present invention, the first flange 40 is integrally formed with the plate 5. Likewise, the second flange 60 is integrally formed with the plate 5, in many embodiments of the present invention.

Figure 2:
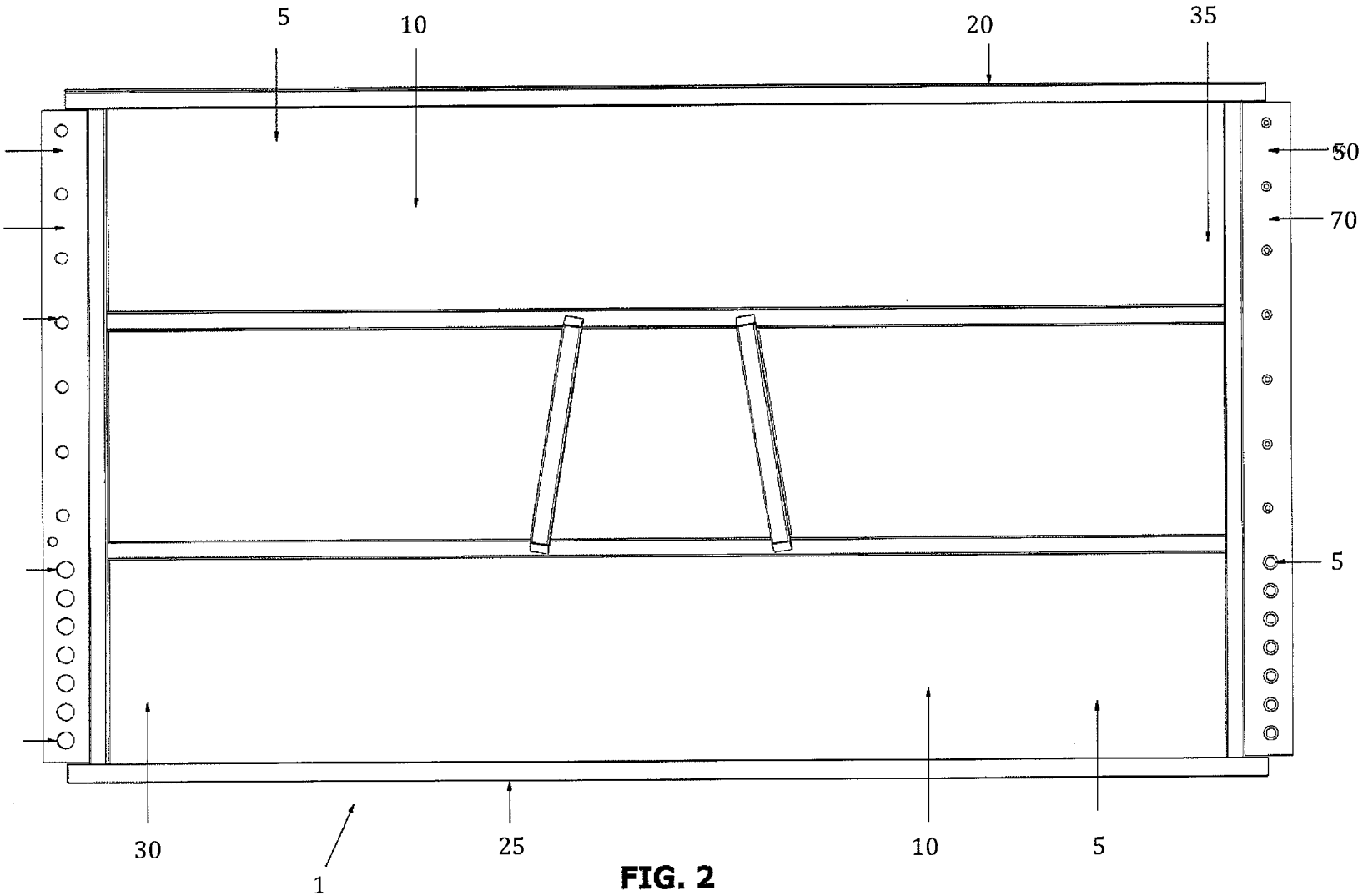
FIG. 2 illustrates a front view of the top of the embodiment of the present invention shown in FIG. 1 hereof.

FIG. 2 illustrates a front view of the top of the embodiment of the present invention as depicted in FIG. 1. FIG. 2 further depicts the pegs 75 and holes 55 having a higher density of both at the bottom portion of the flange. FIG. 2 shows one embodiment of the present invention wherein the pegs 75 and corresponding holes 55 have a larger diameter toward the bottom portion of the first flange 40 and the second flange 60. This further secures connection between panels because the lower, larger diameter pegs 75 have additional sheer strength and are able to accommodate greater pressures against the inner surface of the panel 1.

Figure 3:
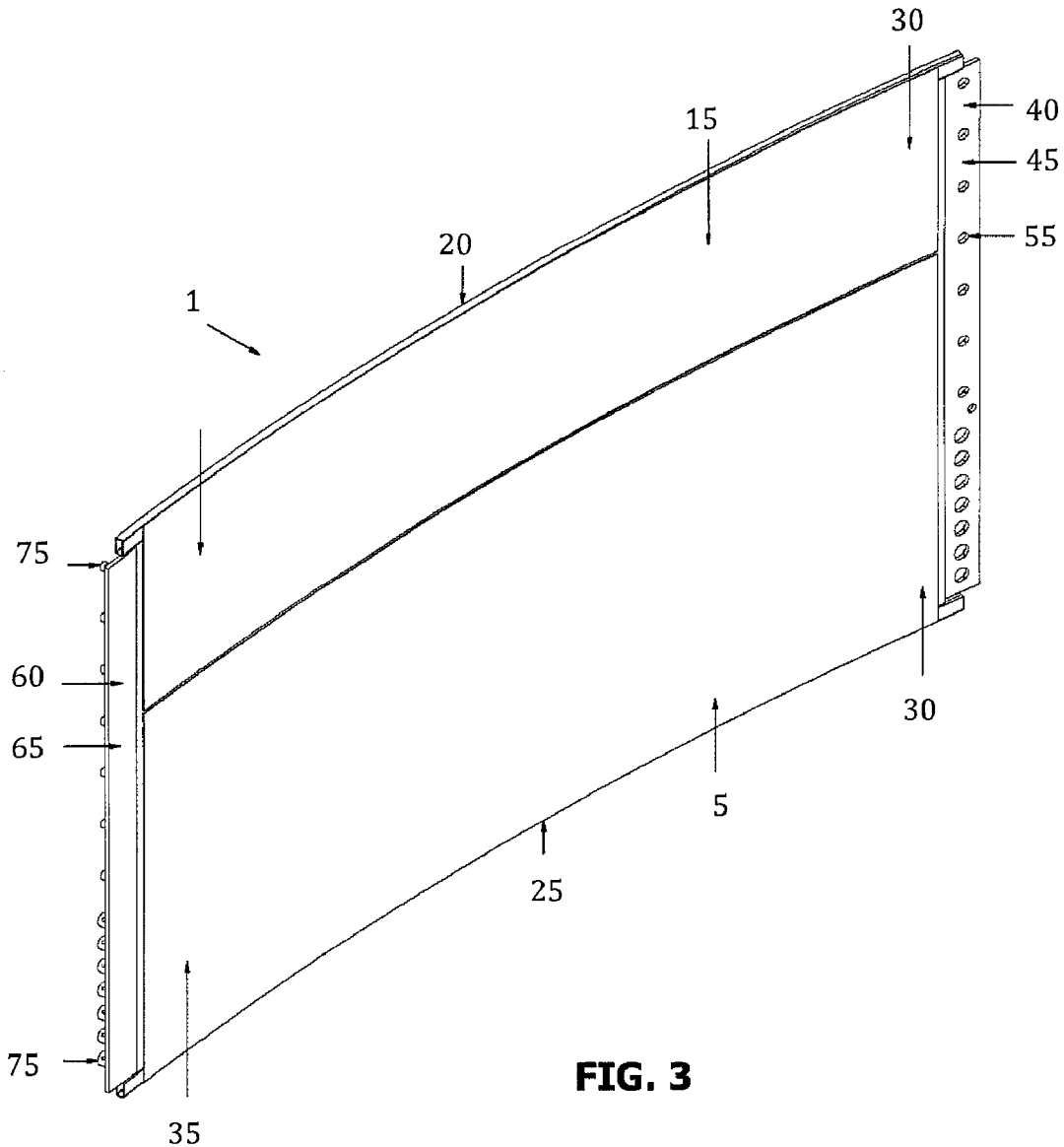
FIG. 3 illustrates another perspective view of the embodiment of the present invention shown in FIG. 1 and FIG. 2 hereof, further showing the inner surface, first and second flanges and top edge.

FIG. 3 depicts the inner surface 15 of the plate 5 of the panel 1 having a top edge 20 and a bottom edge 25. The plate 5 is attached to the first flange 40 at the first edge 30. The plate 5 is attached to the second flange 60 at the opposing second edge 35. FIG. 3 depicts the first flange inner face 45 and the second flange inner face 65. FIG. 3 illustrates the first flange 40 having holes 55. The second flange 60 has pegs 75.

Figure 4:
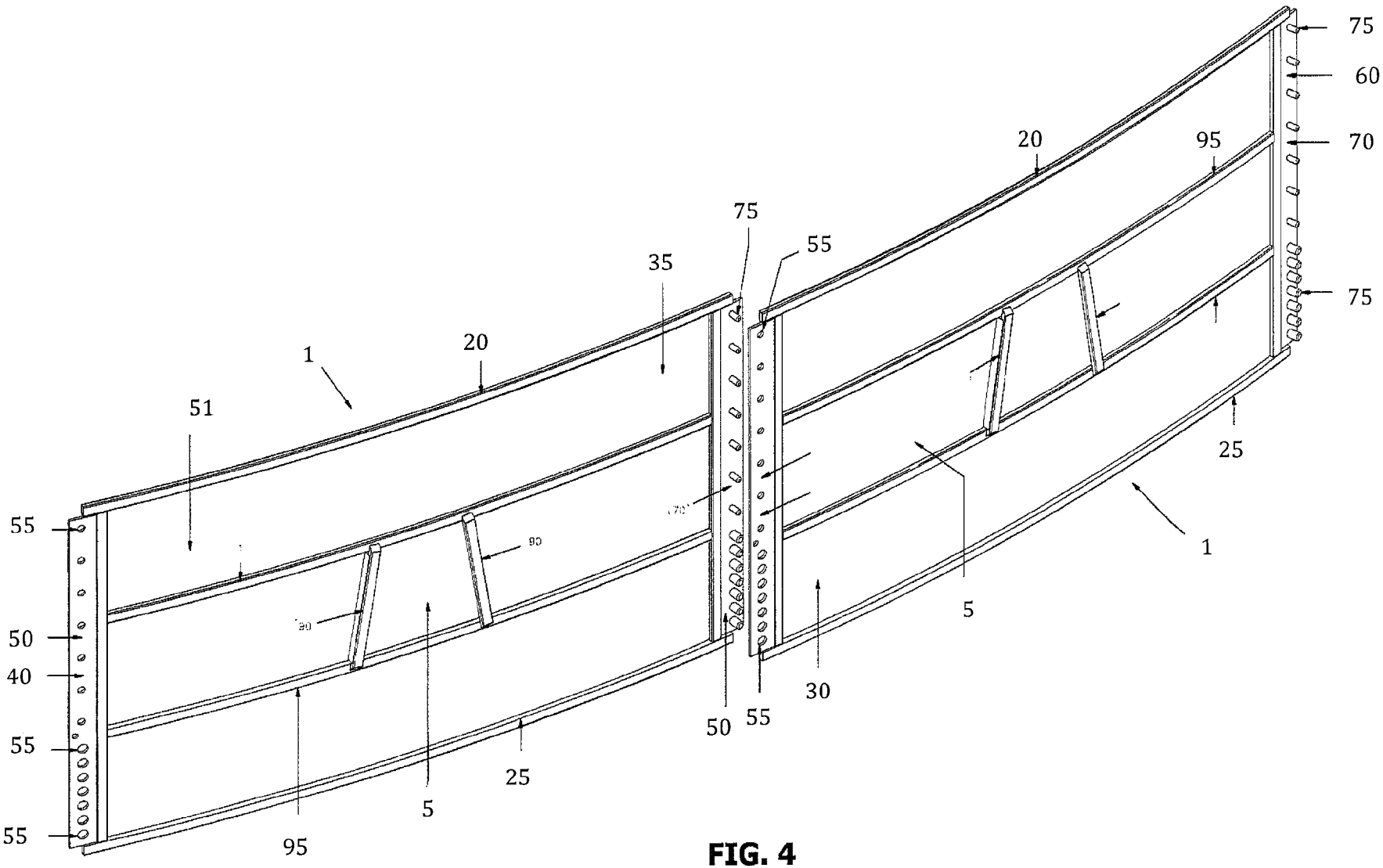
FIG. 4 illustrates a perspective view of yet another embodiment of the present invention as seen from the outer surface, further showing two panels prior to connection of the two panels.

FIG. 4 depicts a perspective view of the outer surface of two panels prior to connection of the two panels. The pegs 75 of the second flange 60 of one panel will penetrate the holes 55 of the first flange 40 of another panel. In this representation of the present invention the second flange outer face 70 is aligned opposite the first flange inner face 45 (not depicted).

Figure 5:
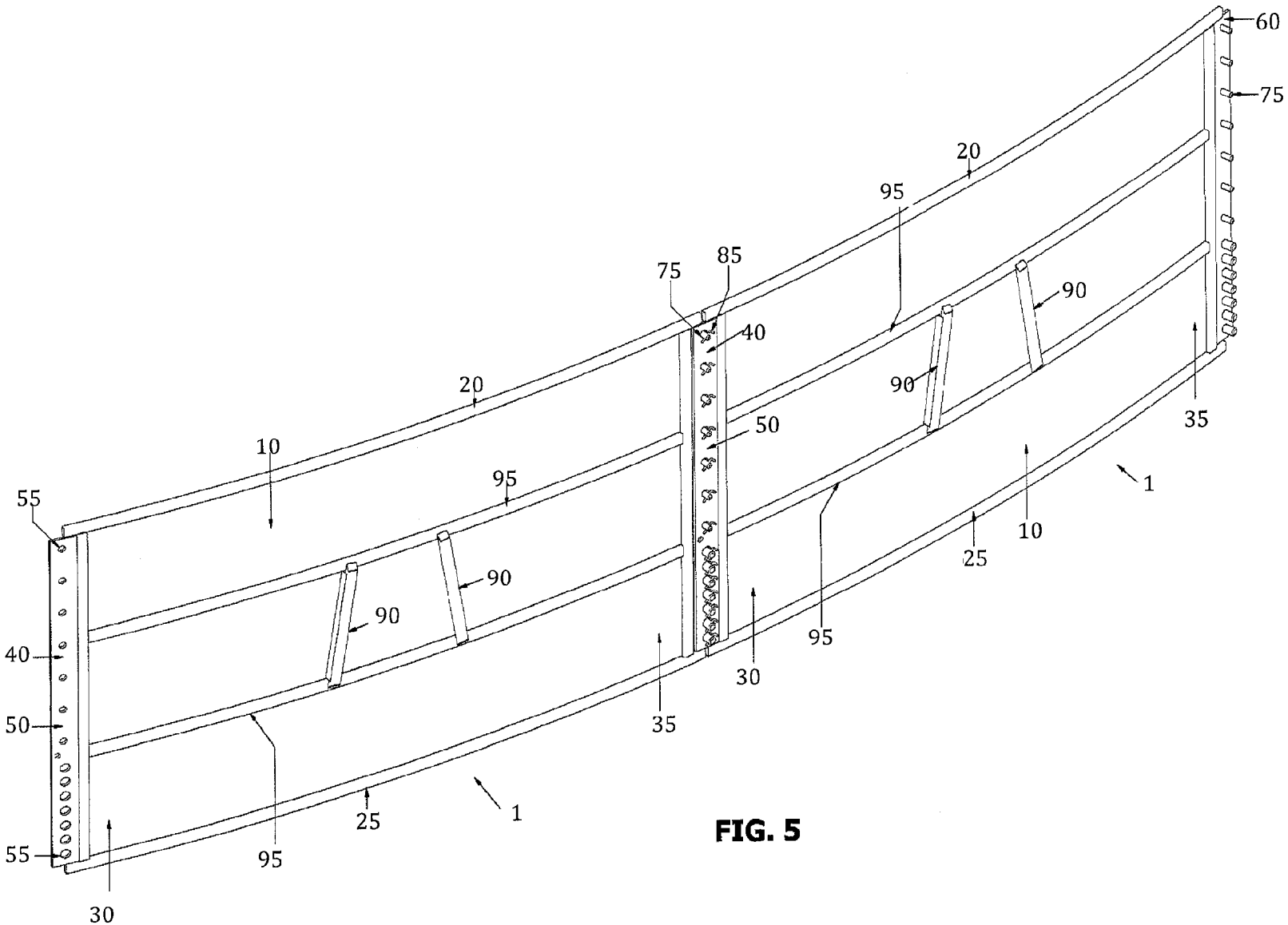
FIG. 5 illustrates a perspective view of yet another embodiment of the present invention as shown in FIG. 4, further showing two panels connected.

FIG. 5 depicts a perspective view of the outer surface after the connection of two panels. In this representation, the outer face 75 of the second flange 60 contacts the inner face (not depicted) of the first flange 40. The pegs 75 penetrate the holes 55. Furthermore, FIG. 5 depicts pins 85 penetrating the pegs 75 in order to further secure the interlocking panels.

Figure 6:
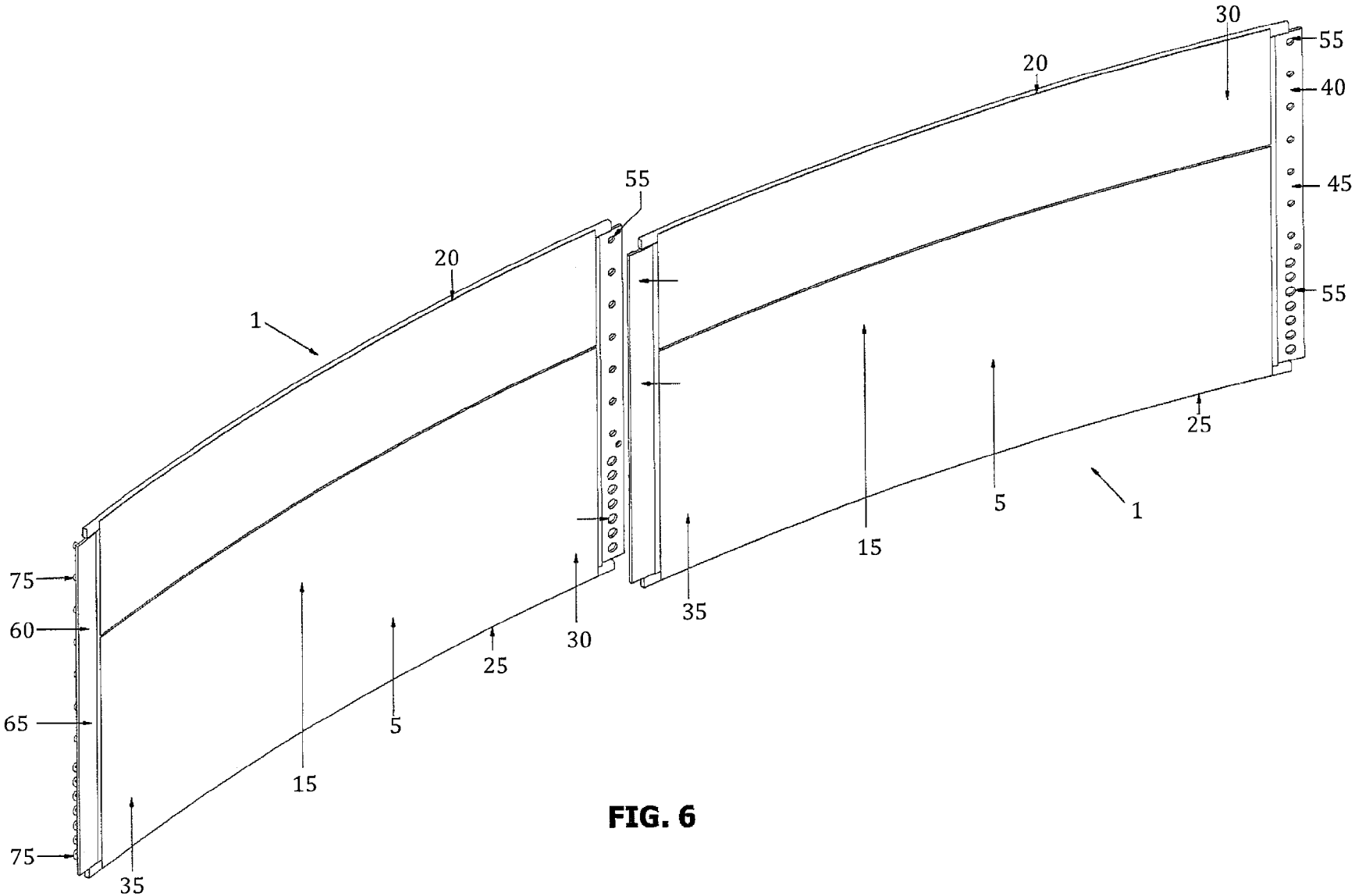
FIG. 6 illustrates a perspective view of yet another embodiment of the present invention as seen from the inner surface, further showing two panels prior to connection of two panels.

FIG. 6 depicts a perspective view of the inner surface of two panels prior to the interlocking connection. FIG. 6 is the inside view of the invention shown in FIG. 4, i.e., prior to connection of panels.

Figure 7:
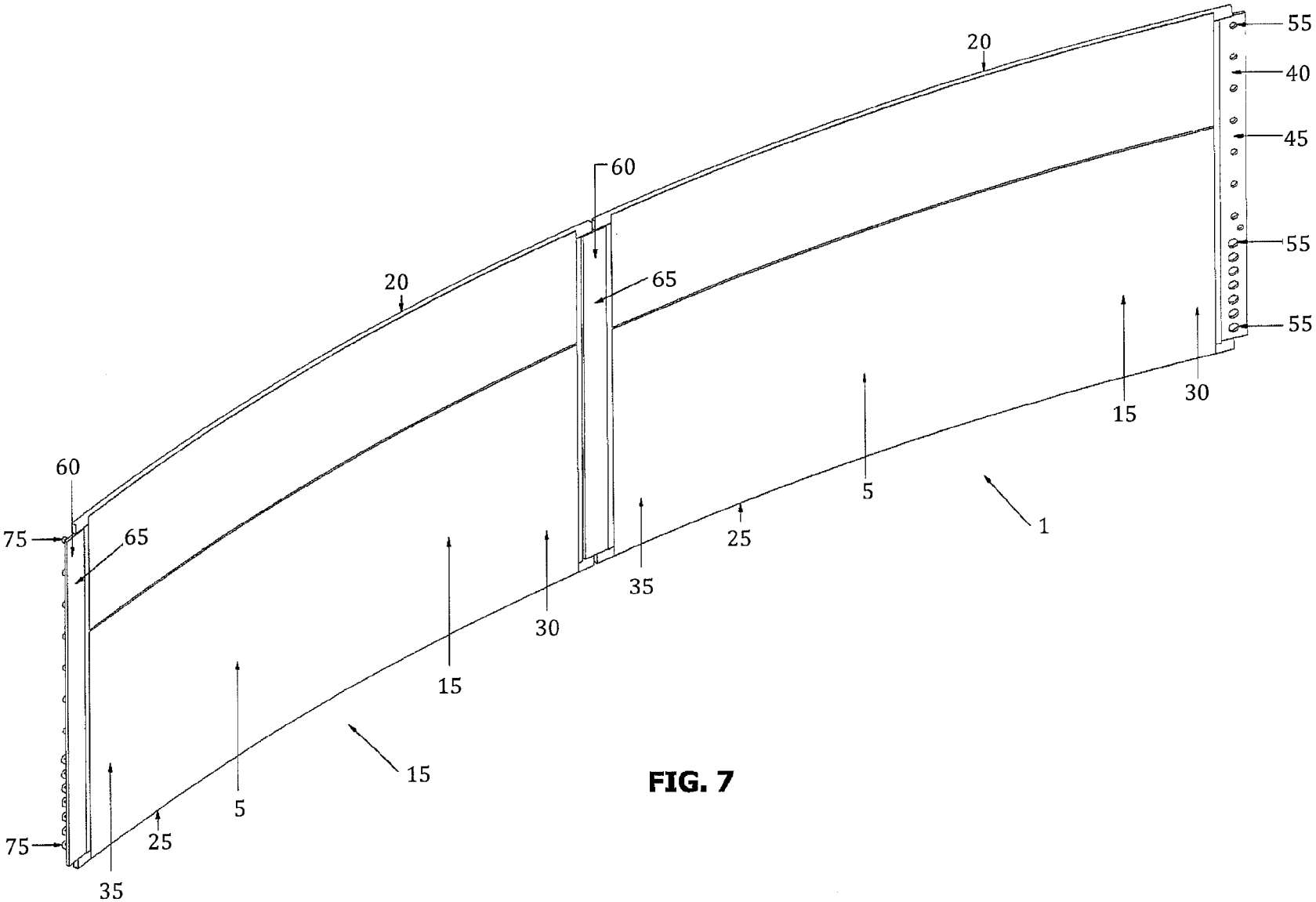
FIG. 7 illustrates a perspective view of yet another embodiment of the present invention as shown in FIG. 6, further showing two panels connected.

FIG. 7 depicts a perspective view of the inner surface after the connection of two panels. FIG. 7 depicts the inside view of the invention shown in FIG. 5, i.e., when connection of the panels occurs.

Figure 8B:
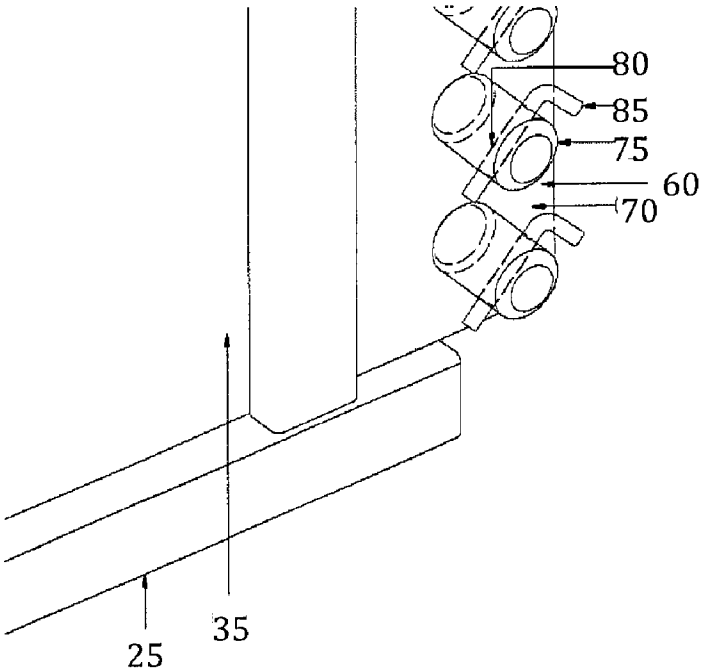
FIG. 8A and FIG. 8B illustrate a perspective view of one embodiment the pin connection mechanism which secures connection of the panel flanges.
Figure 8A:
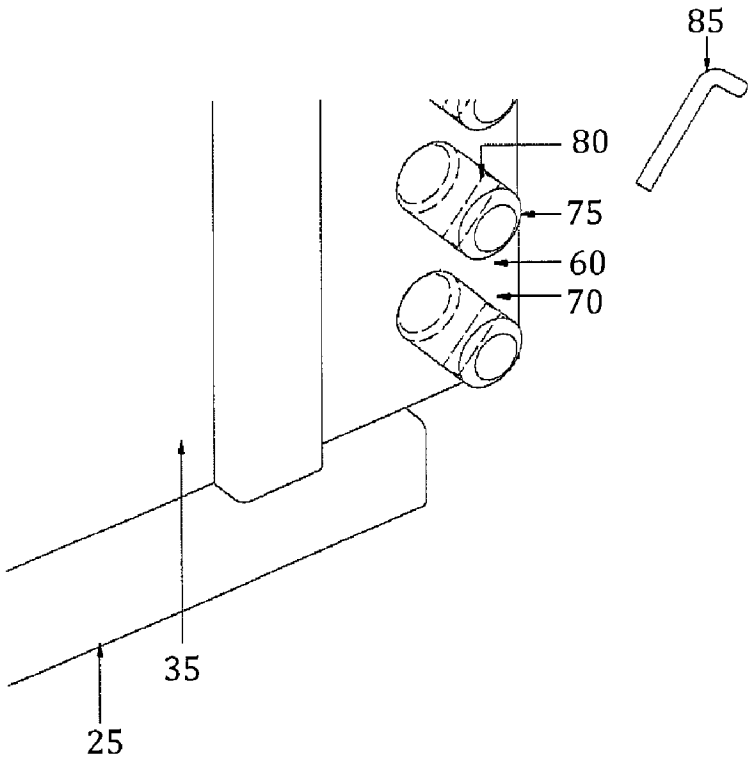

FIG. 8A depicts the pin 85 and the peg 75 with a cut out representation of the eyelet 80 to accommodate penetration of the pin 85. FIG. 8B more depicts the pin 85 penetrating the peg 75 through the eyelet as show previously in FIG. 8A. The pin 85 goes through the peg 75 via the eyelet 80 (not depicted). In one embodiment of the present invention, the eyelet 80 is at an angle of roughly 45° relative to the bottom edge 25.

Figure 9:
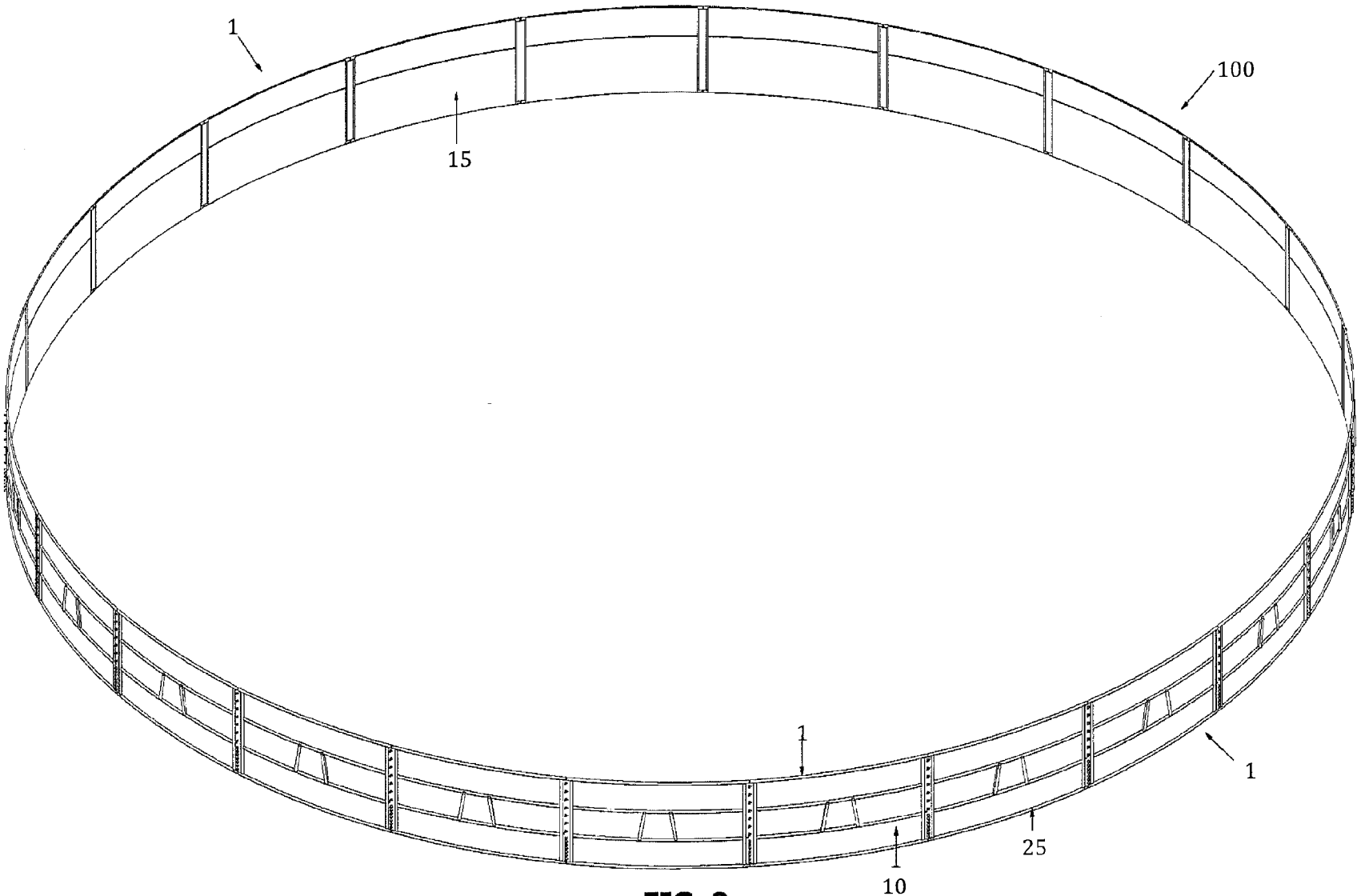
FIG. 9 illustrates a perspective view of one embodiment of the present invention showing panels fully connected and creating a circular reservoir of interlocking panels.

FIG. 9 depicts a top perspective side view of panels fully connected and creating a circular reservoir frame of interlocking panels. The interlocking panels form a variety of shapes in various embodiments, including oval and circles.

Figure 10:
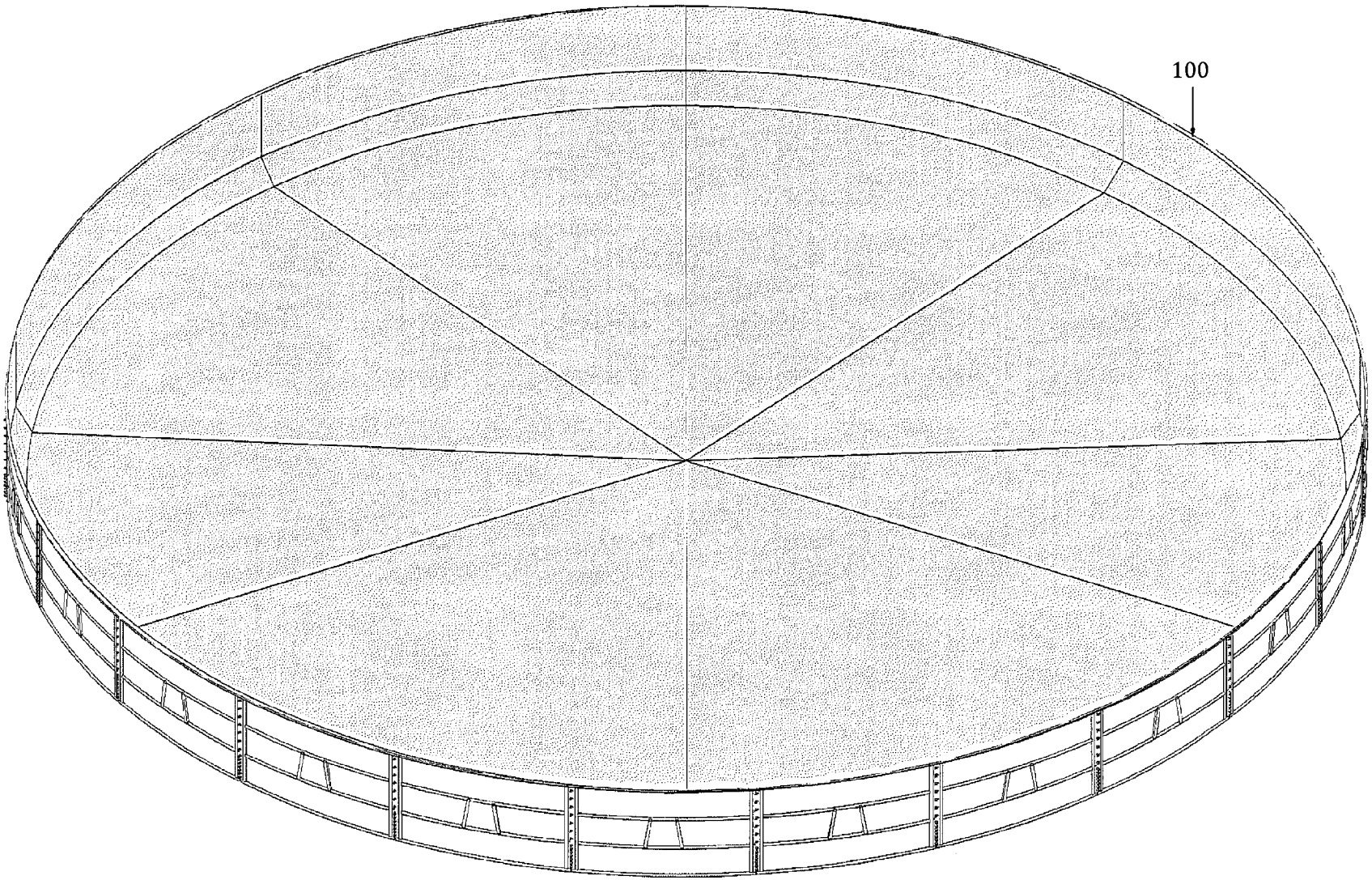
FIG. 10 illustrates a perspective view of one embodiment of the present invention further showing a liner covering the inner surface of the reservoir frame and the bottom of the reservoir as shown in FIG. 9.

FIG. 10 shows a liner 105 covering the inner surface of the reservoir frame and the bottom of the reservoir.

Figure 11:
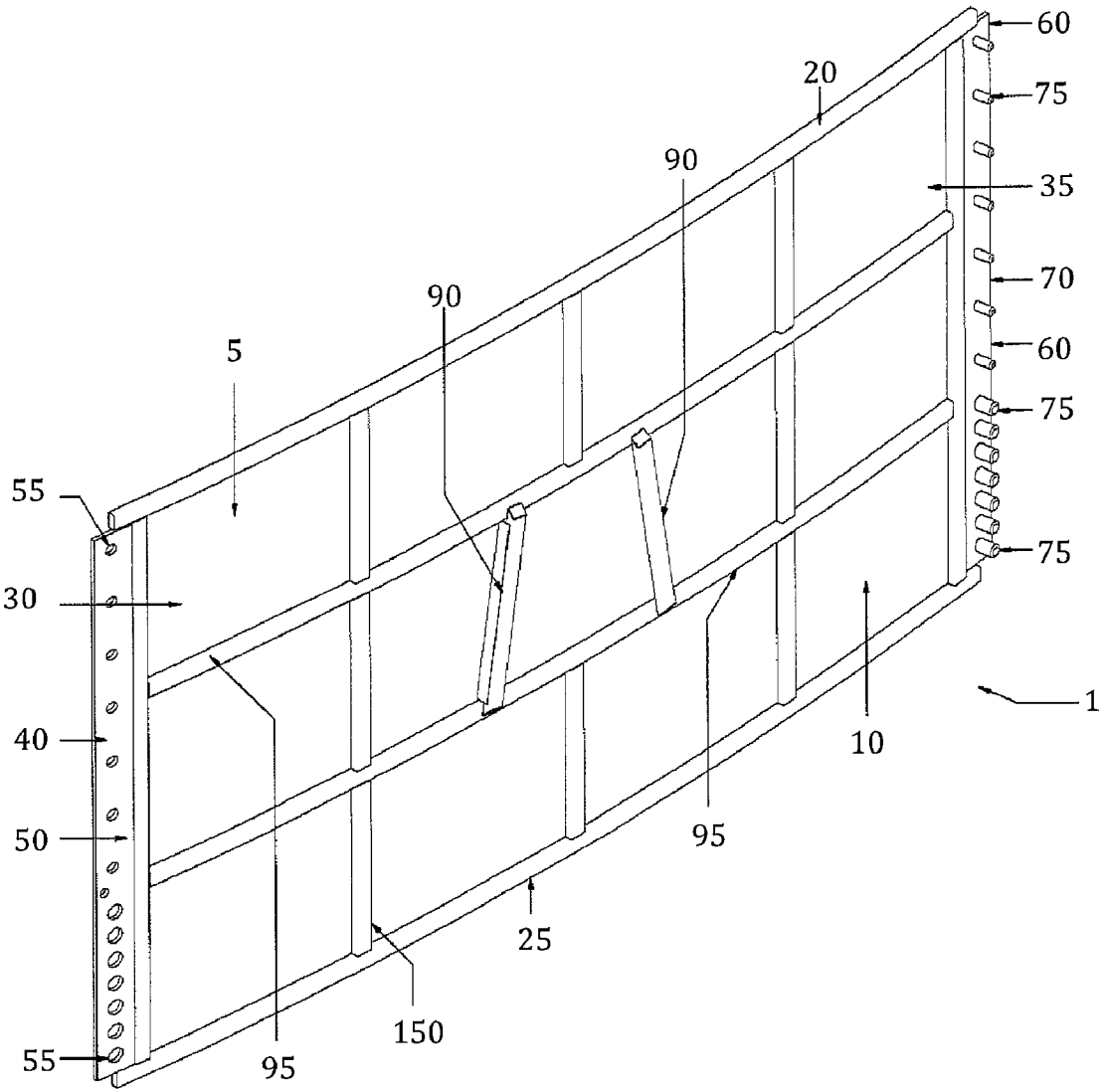
FIG. 11 illustrates a perspective view of one embodiment of the present invention showing panels having additional support beams.

FIG. 11 illustrates a perspective view of one embodiment of the present invention showing panels having vertical support beams 150. Such vertical support beams further secure and support the reservoir panel 1 and plate 5 in order to hold and contain large amounts of liquid in the reservoir frame.

It is believed that the apparatus of the present invention and many of its attendant advantages will be understood from the foregoing description. It is also believed that it will be apparent that various changes may be made in the form, construction, and arrangement of the components without departing from the scope and spirit of the invention and without sacrificing its material advantages. The forms described are merely exemplary and explanatory embodiments thereof. It is the intention of the following claims to encompass and include such changes.

What is claimed is:

1. A portable reservoir frame comprising:

two or more interlocking panels, each of said panels comprising, a plate having an outer surface, an inner surface, a top edge, a bottom edge, a first edge and an opposing second edge, said first and said second edges being disposed between said top edge and said bottom edge;

a first flange having an inner face, an outer face, and at least one hole perforating said first flange, said first flange attached to said plate and extending beyond the first edge;

a second flange having an inner face and an outer face, said second flange attached to said plate and extending beyond the opposing second edge; and at least one peg attached to said second flange, each of said at least one peg adapted for insertion into one of said at least one holes of an adjacent interlocking panel, each of said at least one peg has a hole therein.

2. The portable reservoir frame of claim 1, further comprising at least one pin adapted for insertion into the hole in said at least one peg.

3. The portable reservoir frame of claim 1, wherein said plates have convex curvature of the outer surface and concave curvature of the inner surface.

4. The portable reservoir frame of claim 3, wherein one of said interlocking panels connects to another of said interlocking panels, wherein at least one of said at least one peg of one panel is inserted into at least one of said at least one hole of said other plate.

5. The portable reservoir of claim 4, wherein at least 2 interlocking panels are connected to form a generally circular reservoir.

6. The portable reservoir of claim 4, wherein said at least one pin is inserted to lock the interlocking panels together.

7. The portable reservoir frame of claim 4, further comprising a liner adapted for covering the inside of the generally circular reservoir frame.

8. The portable reservoir frame of claim 1, further comprising at least one crossbar attached to said outer surface of the plate.

9. The portable reservoir frame of claim 1, further comprising at least one horizontal support beam attached to the plate and disposed between the first and second edge and said support beam disposed generally parallel to the top edge and bottom edge of the plate.

10. The portable reservoir frame of claim 9, further comprising at least one crossbar attached to said at least one support beam of the plate.

11. The portable reservoir frame of claim 1, wherein the first flange is integrally formed with said plate.

12. The portable reservoir frame of claim 1, wherein the second flange is integrally formed with said plate.

13. The portable reservoir frame of claim 1, wherein said at least one peg is integrally formed with said second flange.

14. A portable reservoir frame comprising:

a plurality of interlocking panels, each panel comprising, a plate having an outer surface, an inner surface, a top edge, a bottom edge, a first edge and a second edge, a first crossbar member and a second crossbar member secured to the outer surface of the plate, said first and second crossbar members configured to receive a lifting device for lifting and moving the panel, wherein said first and second crossbar members are positioned on the outer surface of the plate in a shape similar to the sides of a trapezoid, a plurality of peg members secured to the first edge of the plate, wherein the plurality of peg members are configured to be inserted within a corresponding hole of an adjacent panel of the reservoir frame, and secured with a securing pin sized to fit within an eyelet in said pin, and a plurality of holes disposed within the second edge of the plate, each of said holes sized to receive a corresponding peg member of an adjacent panel to create an interlocking connection.

15. The portable reservoir frame of claim 14, further comprising a liner for covering the inner surface of the portable reservoir frame for retaining water.

16. A method of constructing a portable reservoir frame comprising a plurality of interlocking panels, the method comprising:

providing a plurality of interlocking panels, each panel comprising, a plate having an outer surface, an inner surface, a top edge, a bottom edge, a first edge and a second edge, a plurality of peg members secured to the first edge of the plate, each of said plurality of peg members having a hole therein, and a plurality of holes disposed within the second edge of the plate, each of said holes sized to receive a corresponding peg member of an adjacent panel to create an interlocking connection;

positioning a first panel of the plurality of interlocking panels adjacent a second panel;

inserting the plurality of peg members secured to the first edge of the plate of said first panel into a corresponding hole of said plurality of holes disposed within the second edge of the plate of said second panel to create an interlocking connection and secure the first and second panels together; and repeating the steps of positioning and inserting until the portable reservoir frame is constructed.

* * * * *